US006552709B1

(12) United States Patent
Yamaguchi

(10) Patent No.: US 6,552,709 B1
(45) Date of Patent: Apr. 22, 2003

(54) POWER-ON DISPLAY DRIVING METHOD AND DISPLAY DRIVING CIRCUIT

(75) Inventor: Hisashi Yamaguchi, Tokyo (JP)

(73) Assignee: NEC Corporation, Tokyo (JP)

( * ) Notice: Subject to any disclaimer, the term of this patent is extended or adjusted under 35 U.S.C. 154(b) by 183 days.

(21) Appl. No.: 09/707,485

(22) Filed: Nov. 7, 2000

(30) Foreign Application Priority Data

Nov. 8, 1999 (JP) ..... 11-316872

(51) Int. Cl.[7] ..... G08G 3/36

(52) U.S. Cl. ..... 345/99; 345/98; 345/100; 345/204

(58) Field of Search ..... 345/94–95, 98–100, 345/103, 204, 208, 211–213; 713/300, 310, 320

(56) References Cited

U.S. PATENT DOCUMENTS 5,254,888 A * 10/1993 Lee et al. ..... 327/298
6,091,392 A * 7/2000 Imamura ..... 345/100
6,091,393 A * 7/2000 Park ..... 345/100
6,335,715 B1 * 1/2002 Lee ..... 345/87

FOREIGN PATENT DOCUMENTS

| | | | |
|---|---|---|---|
| JP | HEI 4-204993 | 7/1992 | |
| JP | 11-143432 | 5/1999 | ..... G09G/3/36 |
| KR | 97-0063021 | 9/1997 | |

* cited by examiner

*Primary Examiner*—Lun-Yi Lao
*Assistant Examiner*—Tom V. Sheng
(74) *Attorney, Agent, or Firm*—Scully, Scott, Murphy & Presser

(57) ABSTRACT

In a display driving method, after turning a power supply ON, a shift clock $CK_{I2}$ of a period of 1 $\mu$s is supplied to a shift register in a scanning electrode driving circuit as a shift clock $CK_2$ instead of a shift clock $CKN_2$ of one horizontal synchronous period for n-periods corresponding to n-pieces of scanning electrodes of a liquid crystal, and by an enable signal EN which becomes a "H" level during a period corresponding to n-periods at least, each bit of output data of a shift driver is stopped from transferring to n-pieces of drivers for driving n-pieces of scanning electrodes of a liquid crystal display panel.

20 Claims, 7 Drawing Sheets

FIG.4
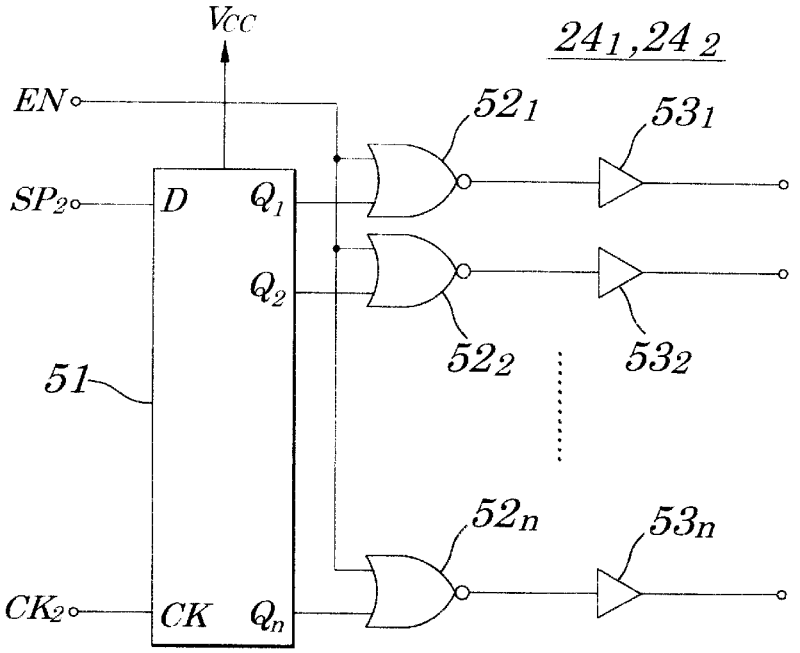
FIG.5A
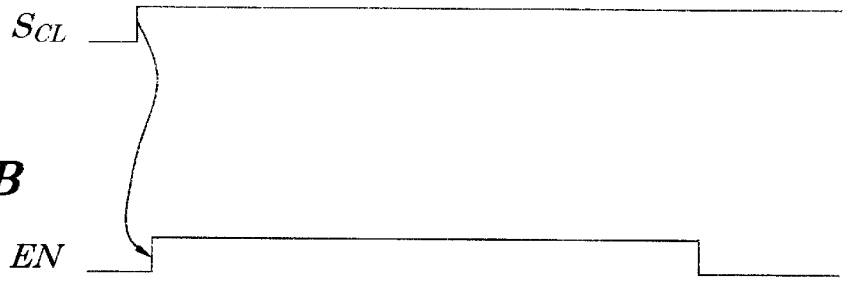
FIG.5B
FIG.5C
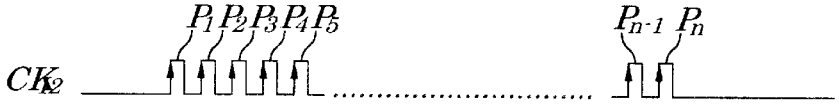

POWER-ON DISPLAY DRIVING METHOD AND DISPLAY DRIVING CIRCUIT

BACKGROUND OF THE INVENTION

1. Field of the Invention

The present invention relates to a display driving method and a display driving circuit and more particularly to the display driving method and the display driving circuit for a display such as a liquid crystal panel and an electroluminescence panel (EL panel).

The present application claims the Convention Priority of Japanese Patent Application No. Hei11-316872 filed on Nov. 8, 1999 Hei11-316872 filed on Nov. 8, 1999, which is hereby incorporated by reference.

2. Description of the Related Art

FIG. 7 is a block diagram showing an electric configuration example of a conventional liquid crystal panel 1 and a display driving circuit disclosed in Japanese Patent Application Laid-open No. Hei11-143432.

The liquid crystal panel 1 is an active matrix driving liquid crystal panel using a thin film transistor (TFT) used as a switch element. Intersection points of n-pieces (n is a positive integer) of scanning electrode $\mathbf{2}_1$ to scanning electrode $\mathbf{2}_n$ (gate line) provided at predetermined intervals in a row direction and m-pieces (m is a positive integer) of data electrode $\mathbf{3}_1$ to data electrode $\mathbf{3}_m$ (source line) provided at predetermined intervals in a column direction are used as pixels. For each pixel, a liquid crystal cell 4 which is an equivalent capacitive load, a TFT 5 for driving a corresponding liquid crystal cell 4 and a capacitor 6 for storing data charges for one vertical synchronous period are arranged. A data red signal, a data green signal and a data blue signal generated based on a red data $D_R$, a green data $D_G$ and a blue data $D_B$ to be digital image data are sequentially applied to data electrode $\mathbf{3}_1$ to data electrode $\mathbf{3}_m$ and scanning signals are sequentially applied to scanning electrode $\mathbf{2}_1$ to scanning electrode $\mathbf{2}_n$, and thereby a character, an image or a like are displayed.

Further, the conventional display driving circuit of this example is a semiconductor integrated circuit of a CMOS (Complementary Metal Oxide Semiconductor) configuration mainly including a controller 7, a data electrode driving circuit 8 and a scanning electrode driving circuit 9.

The controller 7 generates a start pulse $SP_1$ and a shift clock $CK_1$ to be supplied to the data electrode driving circuit 8 and a start pulse $SP_2$, a shift clock $CK_2$ and an enable signal EN to be supplied to the scanning electrode driving circuit 9.

The data electrode driving circuit 8 is mainly provided with a shift register, a data register, a latch, a level shifter, a digital analog converter (DAC) and plural drivers (not shown).

The data electrode driving circuit 8 starts to take red data $D_R$, green data $D_G$, and blue data $D_B$ synchronously with the shift clock $CK_1$ into the shift register based on the start pulse $SP_1$, and then, takes output data from the shift register into the data register at a rising of the shift clock $CK_1$. Then, the data electrode driving circuit 8 holds the output data temporarily in the latch, converts it into a predetermined voltage by the level shifter, converts the predetermined voltage into analog data red signal, analog data green signal and analog data blue signal by the DAC, applies amplification and buffer to these signals and sequentially applies them to a corresponding data electrode among data electrode $\mathbf{3}_1$ to data electrode $\mathbf{3}_m$ in the crystal panel 1 by the plural drivers.

The scanning electrode driving circuit 9, as shown in FIG. 8, is mainly provided with a shift register 10, NAND gate $\mathbf{11}_1$ to NAND gate $\mathbf{11}_n$ and driver $\mathbf{12}_1$ to driver $\mathbf{12}_n$.

The shift register 10 is a serial-in parallel-out shift register including n-pieces of delay flip-flops (DFFS), executes a shift operation for shifting the start pulse $SP_2$ synchronously with the shift clock $CK_2$ based on a power supply voltage $V_{CC}$ and supplies each bit of n-bits of parallel data to each second input terminal of NAND gate $\mathbf{11}_1$ to NAND gate $\mathbf{11}_n$. Each of NAND gate $\mathbf{11}_1$ to the NAND gate $\mathbf{11}_n$ inverts each bit of n-bits parallel data and supplies an inverted bit to a corresponding driver among driver $\mathbf{12}_1$ to driver $\mathbf{12}_n$ when each enable signal EN supplied from the controller 7 to each first input terminal is an "H" level. Each driver $\mathbf{12}_1$ to the driver $\mathbf{12}_n$ applies amplification and buffer to each bit of n-bits of parallel data inverted and supplied from a corresponding NAND gate (NAND gate $\mathbf{11}_1$ to NAND gate $\mathbf{11}_n$) and sequentially applies it to a corresponding scanning electrode among scanning electrode $\mathbf{2}_1$ to scanning electrode $\mathbf{2}_n$ as n-pieces of scanning signals in the liquid crystal panel 1.

Next, explanations will be given of a part of an operation in the display driving circuit of the above-mentioned configuration. First, when a power supply is turned ON, the power supply voltage $V_{CC}$ is applied to the shift register 10 in the scanning electrode driving circuit 9.

In this case, in order to avoid latch-up in the scanning electrode driving circuit 9, the controller 7 applies a power-on-reset (not shown) so as to not output various control pulses until a constant time in which the power supply voltage $V_{CC}$ becomes stable passes after the power supply is turned ON.

Here, the latch-up is a phenomenon in which an electric current continuously flows from a power supply terminal to a ground terminal so long as the power supply voltage is lowered in a semiconductor integrated circuit of a CMOS configuration. Explanations will be given of reasons that the latch-up occurs in the scanning electrode driving circuit 9. Immediately after turning the power supply ON, output data from the shift register is irregular. When such irregular output data are directly supplied to driver $\mathbf{12}_1$ to driver $\mathbf{12}_n$, in a worst case, namely, in a case in that all output data of the shift register 10 are different, an irregular over-current exceeding current supply capacities of driver $\mathbf{12}_1$ to driver $\mathbf{12}_n$ which is a current of several times of a capacity in a normal operation flows into all driver $\mathbf{12}_1$ to the driver $\mathbf{12}_n$ and a large voltage drop occurs, therefore, the latch-up occurs.

Then, after the constant time passes and power-on-reset is released, the controller 7 supplies the start pulse $SP_2$ of one vertical synchronous period and the shift clock $CK_2$ of one horizontal synchronous period to the shift register 10 and supplies an enable signal EN of an "L" level to each first input terminal of NAND gate $\mathbf{11}_1$ to NAND gate $\mathbf{11}_n$. With this operation, the shift register 10 starts a normal shift operation, however, the enable signal is the "L" level, therefore, regardless of any state of each bit of n-bits of parallel data output NAND gate $\mathbf{11}_1$ to NAND gate $\mathbf{11}n$ is kept at the "H" level.

Then, the shift register 10 starts the normal shift operation, after at least one vertical synchronous period in a display area of the liquid crystal display 1 passes, the controller 7 sets the enable signal EN to the "H" level. With this operation, it becomes possible for NAND gate $\mathbf{11}_1$ to NAND gate $\mathbf{11}_n$ to invert and output each bit of n-bits of parallel data supplied from the shift resister 10. Therefore, when a next start pulse $SP_2$ is supplied from the controller 7, driver $\mathbf{12}_1$ to driver $\mathbf{12}_n$ apply amplification and buffer to each bit of n-bits of parallel data inverted and supplied from a corresponding NAND gate among NAND gate $\mathbf{11}_1$ to NAND gate $\mathbf{11}_n$ and sequentially apply to a corresponding scanning electrode among scanning electrode $\mathbf{2}_1$ to scanning electrode $\mathbf{2}_n$ in the liquid crystal panel 1 as n-pieces of scanning signals.

As above described, with this configuration of the example, output data of the shift register 10 are not transferred to each driver $\mathbf{12}_1$ to driver $\mathbf{12}_n$ until all irregular output data of the shift register 10 are erased immediately after releasing the power-on-reset of the controller 7. As a result, it is possible for driver $\mathbf{12}_1$ to driver $\mathbf{12}_n$ to prevent an irregular over-current from occurring and to keep a current of a normal value and it is possible to completely prevent a latch-up from occurring.

Now, in the above-mentioned conventional display driving circuit, during at least one vertical synchronous period in the display area of the liquid crystal panel 1 after the shift register starts a normal shift operation, a shift clock $CK_2$ of one horizontal synchronous period is supplied to the shift register and thereby irregular output data of the shift register 10 immediately after turning the power supply ON are erased, so that the shift register 10 is initialized.

In such initialization of the shift register 10, there is a problem in that a character, an image and a like can be displayed on the liquid crystal panel 1 for a long time since no scanning signal is applied to each scanning electrode $\mathbf{2}_1$ to the scanning electrode $\mathbf{2}_n$ during at least one vertical synchronous period in the display area of the liquid crystal panel 1.

SUMMARY OF THE INVENTION

In view of the above, it is an object of the present invention to provide a display driving method and a display driving circuit capable of displaying a character, an image or a like immediately after turning a power supply ON.

According to a first aspect of the present invention, there is provided a display driving method for driving a display in which (n×m) pieces of pixels are arranged at intersection points of n-pieces of scanning electrodes at predetermined intervals in a row direction and m-pieces of signal electrodes at predetermined intervals in a column direction, where n of the n-pieces is a positive integer and m of the m-pieces is a positive integer, by applying each bit of n-bits of parallel data of a shift register for shifting a start pulse synchronously with a first shift clock of one horizontal synchronous period to the n-pieces of scanning electrodes and by applying m-pieces of data signals to the m-pieces of signal electrodes, the display driving method including:

a step of, after tuning a power supply ON, supplying a second shift clock of a period shorter than the one horizontal synchronous period to the shift register for n-periods at least instead of the first shift clock; and a step of stopping each bit of output data from the shift register from transferring to n-pieces of drivers at least during a period corresponding to n-pieces of periods.

In the foregoing, a preferable mode is one wherein all of the n-pieces of drivers are in either an OFF voltage output state or an ON voltage output state by stopping transferring each bit of output data of the shift register to the n-pieces of drivers.

According to a second aspect of the present invention, there is provided a display driving method for driving a display in which (n×m) pieces of pixels are arranged at intersection points of n-pieces of scanning electrodes at predetermined intervals in a row direction and m-pieces of signal electrodes at predetermined intervals in a column direction, where n of the n-pieces is a positive integer and m of the m-pieces is a positive integer, by applying each corresponding bit of n-bits of parallel output data of each of two shift registers for shifting a same start pulse synchronously with a first shift clock of one horizontal synchronous period to both ends of a same scanning electrode among the n-pieces of scanning electrodes and by applying m-pieces of data signals to the m-pieces of signal electrodes, the display driving method including:

a step of, after turning a power supply ON, supplying a second shift clock of a period shorter than the one horizontal synchronous period to the two shift registers for n-periods at least instead of the first shift clock; and a step of stopping each bit of output data from the two shift registers from transferring to each of the n-pieces of drivers at least during a period corresponding to the n-pieces of periods.

In the foregoing, a preferable mode is one wherein all of 2n-pieces of drivers are in either an OFF voltage output state or an ON voltage output state by stopping transferring each bit of output data of the two shift registers to each corresponding driver among the n-pieces of drivers.

Also, a preferable mode is one wherein a period of the second shift clock is 1 $\mu$s.

Furthermore, a preferable mode is one wherein the display is a liquid crystal display or an EL panel.

According to a third aspect of the present invention, there is provided a display driving circuit for driving a display in which (n×m) pieces of pixels are arranged at intersection points of n-pieces of scanning electrodes at predetermined intervals in a row direction and m-pieces of signal electrodes at predetermined intervals in a column direction, where n of the n-pieces is a positive integer and m of the m-pieces is a positive integer, by applying each bit of n-bits of parallel data of a shift register for shifting a start pulse synchronously with a first shift clock of one horizontal synchronous period to the n-pieces of scanning electrodes and by applying m-pieces of data signals to the m-pieces of signal electrodes, the display driving circuit including:

a first shift clock generating circuit for generating a first shift clock of one horizontal synchronous period;

a second shift clock generating circuit for generating a second shift clock of a period shorter than the one horizontal synchronous period;

a shift register for shifting a start pulse synchronously with any one of the first shift clock and the second shift clock and outputting n-bits of parallel output data;

an enable signal generating circuit for generating an enable signal in a non-active state during a predetermined period equal to n-periods of the second shift clock at least after turning a power supply ON;

n-pieces of gate circuits for receiving n-bits of output data of the shift register, for outputting the n-bits of output data of the shift register when the enable signal is in the active state and for not outputting n-bits of output data of the shift register when the enable signal is in the non-active state;

n-pieces of drivers for applying amplification and buffer to each bit of output data of the shift register supplied through the n-pieces of gate circuits and for outputting the output data as n-pieces of scanning signals; and a shift clock switching circuit for supplying the second shift clock to the shift register when the enable signal is in the non-active state and for supplying the first shift clock to the shift register after the predetermined period passes.

In the foregoing, a preferable mode is one wherein all of the n-pieces of drivers become any one of an OFF voltage output state and an ON voltage output state when the n-pieces of gate circuits do not output n-bits of output data of the shift register.

According to a fourth aspect of the present invention, there is provided a display driving circuit for driving a display in which (n×m) pieces of pixels are arranged at intersection points of n-pieces of scanning electrodes at predetermined intervals in a row direction and m-pieces of signal electrodes at predetermined intervals in a column direction, where n of the n-pieces is a positive integer and m of the m-pieces is a positive integer, by applying a corresponding scanning signal among n-pieces of scanning signals to both sides of a same scanning electrode among the n-pieces of scanning electrodes and by applying m-pieces of data signals to the m-pieces of signal electrodes, the display driving circuit including:

a first shift clock generating circuit for generating a first shift clock of one horizontal synchronous period;

a second shift clock generating circuit for generating a second shift clock of a period shorter than the one horizontal synchronous period;

a first shift register and a second shift register for shifting a start pulse synchronously with either the first shift clock or the second shift clock and for respectively outputting n-bits of parallel output data;

an enable signal generating circuit for generating an enable signal in a non-active state during a predetermined period corresponding to n-period of the second shift clock at least after turning a power supply ON;

2n-pieces of gate circuits, each of n-pieces of gate circuits provided for each of the first shift register and the second shift register for receiving each of n-bits of output data of a corresponding shift register in the first shift register and the second shift register, for outputting the n-bits of output data of the corresponding shift register when the enable signal is in the active state and for not outputting n-bits of output data of the corresponding shift register when the enable signal is in the non-active state;

2n-pieces of drivers correspondingly provided for the 2n-pieces of gate circuits and for applying amplification and buffer to a corresponding bit of output data of the corresponding shift register supplied through a corresponding gate circuit among the n-pieces of gate circuits and for outputing the corresponding bit as a corresponding scanning signal; and a shift clock switching circuit for supplying the second shift clock to the first shift register and the second shift register at a same time when the enable signal is in the non-active state and for supplying the first shift clock to the first shift register and the second shift register after the predetermined period passes.

In the foregoing, a preferable mode is one wherein all of the 2n-pieces of drivers become either a OFF voltage output state or an ON voltage output state when the corresponding gate circuit does not output a corresponding bit of output data of the corresponding shift register.

Also, a preferable mode is one wherein the enable signal generating circuit includes:

a clear circuit for waveform shaping a rising edge of a power supply voltage when a power supply is turned ON;

an AND gate for outputting a logic multiplication of the clear signal and the enable signal as a counter enable signal;

a counter cleared when the clear signal rises, for becoming possible to operate by the counter enable signal, for counting up at a rising of the second shift clock and for outputting count data; and a comparator cleared when the clear signal rises, for comparing the count data with setting data corresponding to the predetermined period which is previously set and for outputting the enable signal when the count data agrees with the setting data.

Also, a preferable mode is one wherein the gate circuit is any one of a NOR gate, a NAND gate and a three state buffer.

Also, a preferable mode is one wherein a period of the shift clock is 1 $\mu$s.

Furthermore, a preferable mode is one wherein the display is a liquid crystal display or an EL panel.

With above-mentioned configurations, it is possible to display a character, an image or a like immediately after turning a power supply ON.

Also, after turning a power supply ON, a second shift clock of a period shorter than the one horizontal synchronous period is supplied to the shift register during n-periods at least instead of the first shift clock and each bit of output data from the shift register is stopped from transferring to n-pieces of drivers at least during a period corresponding to n-pieces of periods. As a result, it is possible to prevent an unstable over-current of n-pieces of drivers from occurring so as to set a current of a normal value and to prevent a latch-up from occurring. Also, it is possible to display the character, the image or the like immediately after tuning a power supply ON.

Also, with this configuration, after turning a power supply ON, a second shift clock of a period shorter than the one horizontal synchronous period is supplied to the shift register during n-periods at least instead of the first shift clock and each bit of output data from the shift register is stopped from transferring to the n-pieces of drivers at least during a period corresponding to the n-pieces of periods. As a result, in spite of a large screen, it is possible to prevent an unstable over-current of n-pieces of drivers from occurring so as to set a current of a normal value and to prevent a latch-up from occurring. Also, it is possible to display the character, the image or the like immediately after turning a power supply ON

BRIEF DESCRIPTION OF THE DRAWINGS

The above and other objects, advantages, and features of the present invention will be more apparent from the following description taken in conjunction with the accompanying drawings in which:

FIG. 4 is a block diagram showing an electrical configuration of a scanning electrode driving circuit in the enable signal generating circuit according to the embodiment of the present invention;

FIG. 5A, FIG. 5B and FIG. 5C are timing charts for explaining a part of an operation of the display driving circuit according to the embodiment of the present invention;

DETAILED DESCRIPTION OF THE PREFERRED EMBODIMENTS

Best modes for carrying out the present invention will be described in further detail using an embodiment with reference to the accompanying drawings.

Figure 1:
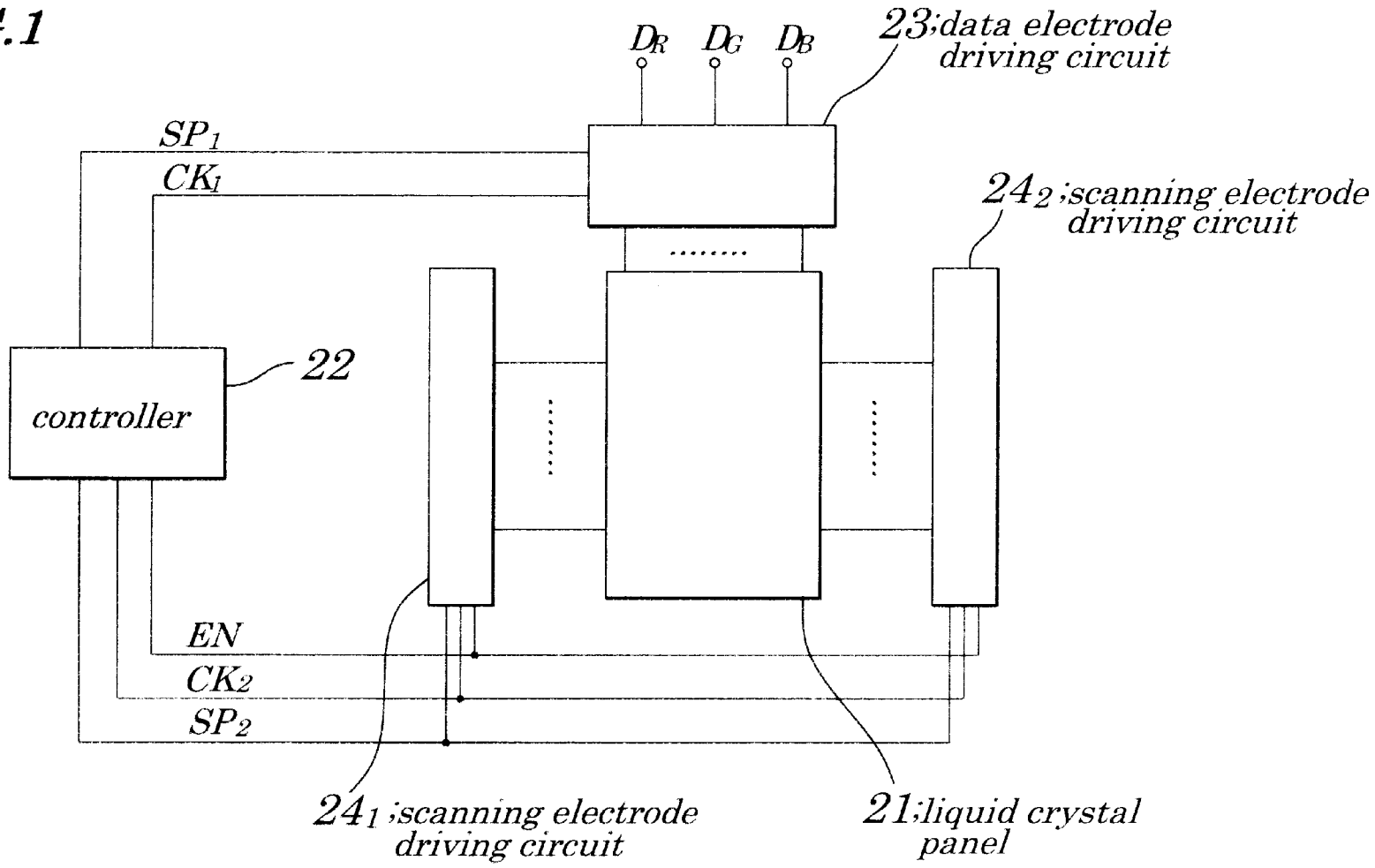
FIG. 1 is block diagram showing an electrical configuration of a driving circuit for a liquid crystal panel according to an embodiment of the present invention.

FIG. 1 is block diagram showing an electrical configuration of a liquid crystal panel 21 and a display driving circuit according an embodiment of the present invention.

Figure 7:
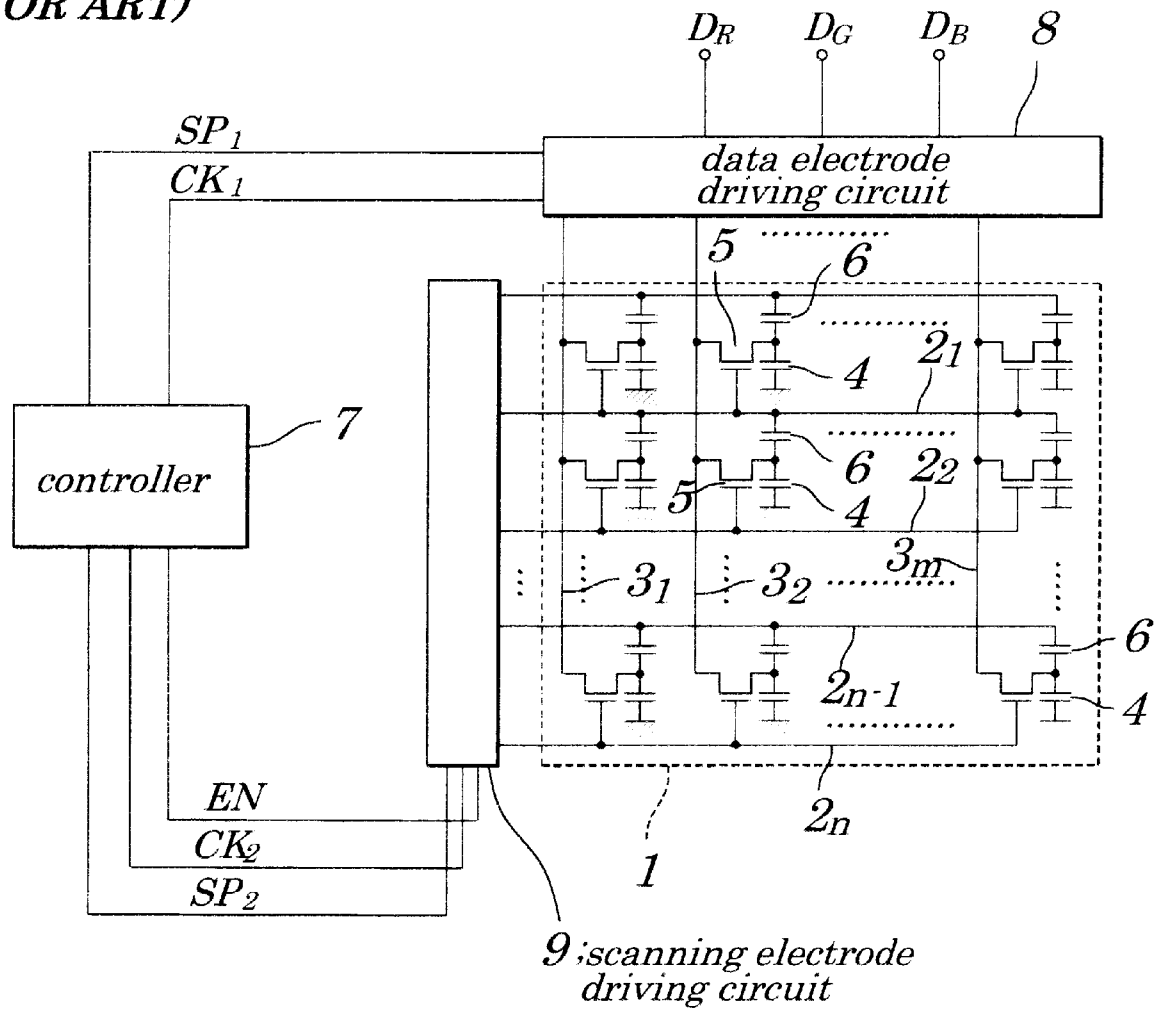
FIG. 7 (PRIOR ART)
FIG. 7 is a block diagram showing a conventional electrical configuration of a driving circuit for a liquid crystal panel and a liquid crystal display.
Figure 8:
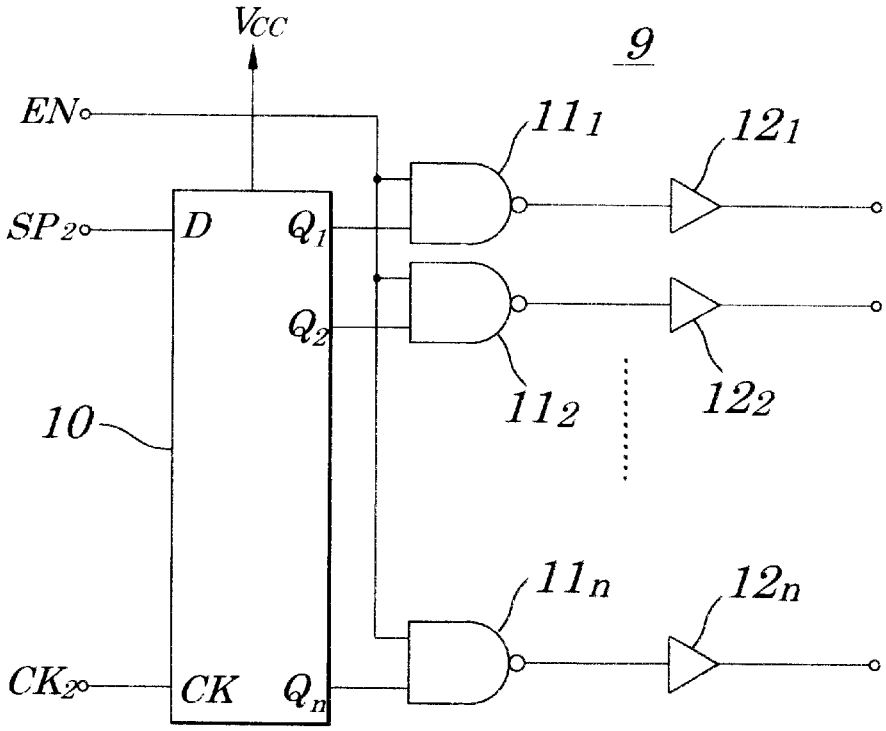
FIG.8 (PRIOR ART)
FIG. 8 is a block diagram showing a conventional electric configuration of a scanning electrode driving circuit in the display driving circuit.

The liquid crystal panel 21 is a large screen liquid crystal panel of eighteen or more inches. A configuration and a function of liquid crystal panel 21 is approximately similar to those of the liquid crystal panel 1 (see FIG. 7), however, the liquid crystal panel 21, with a wide surface area, is provided with plural data electrodes 3, scanning electrodes 2, liquid crystal cells 4, TFTs 5, capacitors 6 (see FIG. 7) and two scanning electrode driving circuits, scanning electrode driving circuit $\mathbf{24}_1$ and scanning electrode driving circuit $\mathbf{24}_2$, having a same configuration and a same function and connectable,to the liquid crystal panel 21 at a right side and at a left side in FIG. 1.

In addition, the display driving circuit of this embodiment is formed by a semiconductor integrated circuit (See FIG. 3) of a CMOS configuration and is mainly provided with a controller 22, a data electrode driving circuit 23, the scanning electrode driving circuit $\mathbf{24}_1$ and the scanning electrode driving circuit $\mathbf{24}_2$.

The controller 22 (See FIG. 2) is mainly provided with a start pulse generating circuit 31 for generating a start pulse $SP_1$ to be supplied to the data electrode driving circuit 23, a shift clock generating circuit 32 for generating a shift clock $CK_1$ to be supplied to the data electrode driving circuit 23, a start pulse generating circuit 33 for generating a start pulse $SP_2$ of one vertical synchronous period to be supplied to the scanning electrode driving circuit $\mathbf{24}_1$ and the scanning electrode driving circuit $\mathbf{24}_2$, a shift clock generating circuit 34 for generating a shift clock $CK_{N2}$ of one horizontal synchronous period (about 63.5 $\mu$s) used by the scanning electrode driving circuit $\mathbf{24}_1$ and the scanning electrode driving circuit $\mathbf{24}_2$ in a normal operation, a shift clock generating circuit 35 for generating a shift clock $CK_{I2}$ of a period shorter than that of the shift clock $CK_{N2}$ (for example, 1 $\mu$s) used by the scanning electrode driving circuit $\mathbf{24}_1$ and the scanning electrode driving circuit $\mathbf{24}_2$ in an initial operation intermediately after turning the power supply ON, an enable signal generating circuit 36 for generating an enable signal EN to be supplied to the scanning electrode driving circuit $\mathbf{24}_1$ and the scanning electrode driving circuit $\mathbf{24}_2$, inverter 37, AND gate 38, AND gate 39, and OR gate 40.

Figure 3:
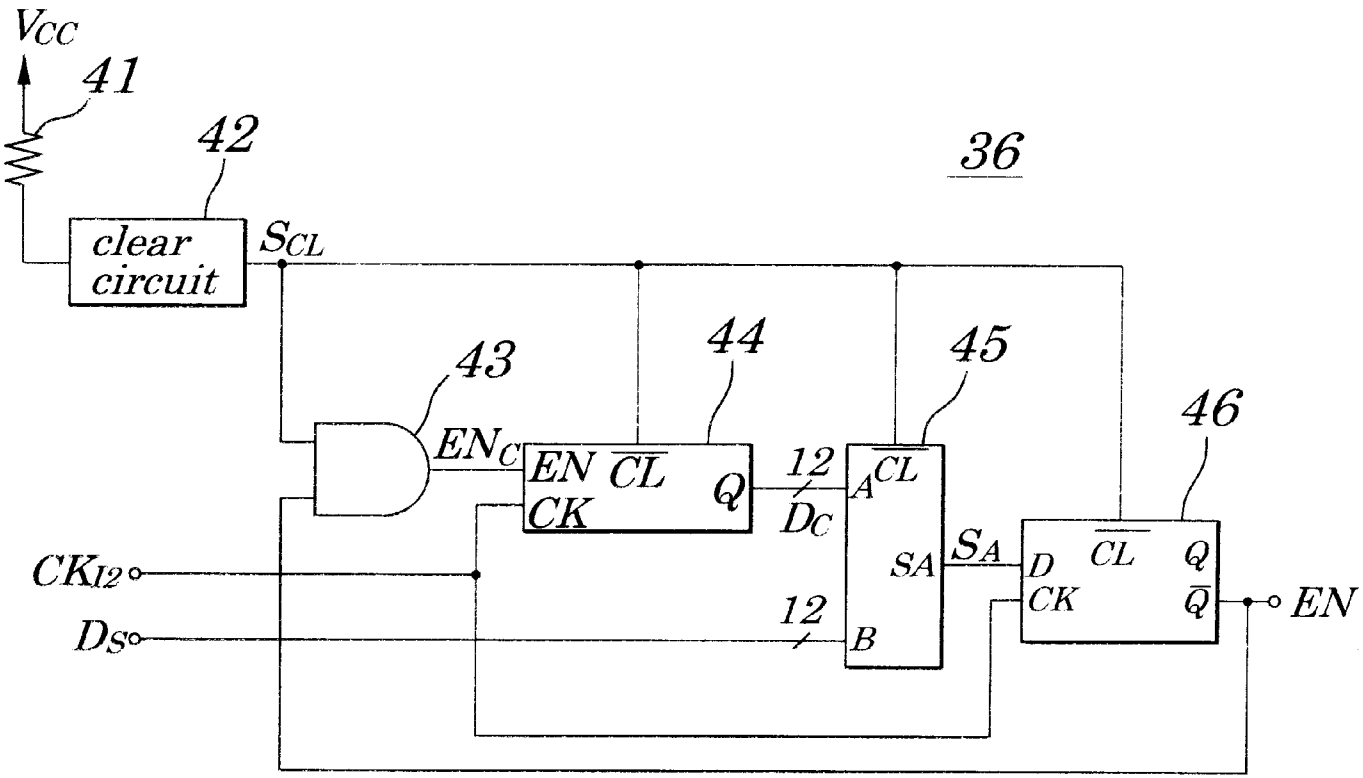
FIG. 3 is a block diagram showing an electrical configuration of an enable signal generating circuit in the controller according to the embodiment of the present invention.

FIG. 3 is a block diagram showing one example of an electrical configuration of the enable signal generating circuit 36.

The enable signal generating circuit 36 is mainly provided with resistor 41, clear circuit 42, AND gate 43, counter 44, comparator 45 and DFF 46.

The clear circuit 42 shapes a waveform of a rising edge of the power supply/voltage $V_{CC}$ applied to the clear circuit 42 via the resistor 41 when the power supply is turned ON and outputs a waveform shaped power supply voltage $V_{CC}$ as a clear signal $S_{CL}$ of a "H" level. The AND gate 43 logically multiplies the clear signal $S_{CL}$ supplied to the first input terminal A and the enable signal EN supplied to the second input terminal B and supplies a logical multiplied result to the counter 44 as a counter enable signal $EN_C$. The counter 44 is an asynchronous counter of twelve bits, is cleared when the clear signal $S_{CL}$ rises and enables to operate by the counter enable signal $EN_C$ of the "H" level, counts up at rising of the shift clock $CK_{I2}$ and supplies count data $D_C$ to a first input terminal A of the comparator 45.

The comparator 45 is cleared when the clear signal $S_{CL}$ rises and compares the count data DC to be supplied to the first input terminal A and a predetermined setting data $D_S$ of twelve bits. When the count data $D_C$ agrees with the setting data $D_S$, the comparator 45 supplies an agreement signal $S_A$ of a "H" level to the data input terminal D of the DFF 46.

In this case, as the setting data $D_S$, since it is necessary to initialize the shift register 51 (FIG. 4) in the scanning electrode driving circuit $\mathbf{24}_1$ or the scanning electrode driving circuit $\mathbf{24}_2$ immediately after the power supply is turned ON, at least a number of steps (n-pieces) in the shift register 51 including n-pieces of DFFs, namely, a value less than a number of scanning electrodes (n-pieces) to be the liquid crystal panel 21 by one is set. As a reason, in order to keep the agreement signal $S_A$ at the rising of the shift clock $CK_{I2}$ in the DFF 46, further a delay of one shift clock $CK_{I2}$ is added, therefore, n-pieces of shift clocks $CK_{I2}$ are supplied to the shift register 51 as the shift clock $CK_2$ while the enable signal EN is in the "H" level. In addition, there may be a case in that all DFFs to be the shift register 51 are not initialized only by supplying n-pieces of shift clocks $CK_{I2}$ caused by a timing gap and a like, therefore, the setting data $D_S$ may be set to a value more than (n−1) by two or three as a margin.

The DFF 46 is cleared when the clear signal $S_{CL}$ rises, keeps the agreement signal $S_A$ supplied to the data input terminal D at a rising of the shift clock $CK_{I2}$ and outputs an invert output /Q as the enable signal EN.

Figure 2:
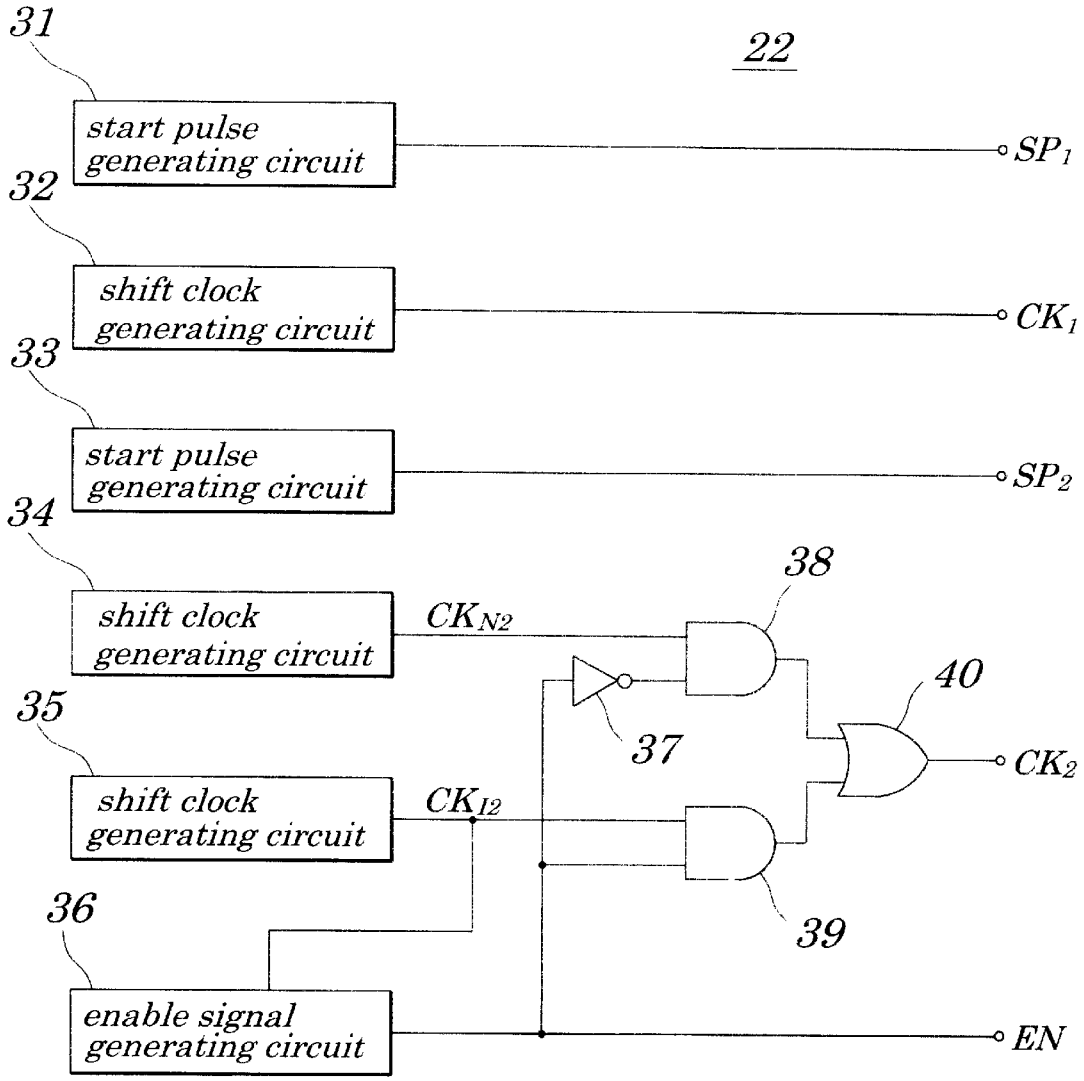
FIG. 2 is a block diagram showing an electrical configuration of a controller in the display driving circuit according to the embodiment of the present invention.

Further, in FIG. 2, the inverter 37, the AND gate 38 and the AND gate 39 and the OR gate 40 form a shift clock switching circuit (not labeled), based on the enable signal EN supplied from the enable signal generating circuit 36, supplying the shift clock $CK_{I2}$ to the scanning electrode driving circuit $\mathbf{24}_1$ and the scanning electrode driving circuit $\mathbf{24}_2$ as the shift clock $CK_2$ in the initial operation immediately after the power supply is turned ON and supply a shift clock $CK_{N2}$ to the scanning electrode driving circuit $\mathbf{24}_1$ and the scanning electrode driving circuit $\mathbf{24}_2$ as the shift clock $CK_2$ in the normal operation.

Further, the data electrode driving circuit 23 shown in FIG. 1, is mainly provided with a shift register, a data register, a latch, a level shifter, a DAC and plural drivers (not shown).

The data electrode driving circuit 23, based on the start pulse $SP_1$, starts to take red data $D_R$, green data $D_G$ and blue data $D_B$ synchronous with the shift clock $CK_1$ into the shift resister 51, takes output data of the shift register into the data resister at rising of the shift clock $CK_1$, holds the output data temporarily, converts the output data into a predetermined voltage in the level shifter, converts the predetermined voltage into analog data red signal, analog data green signal, analog data blue signal in the DAC, applies amplification and buffer to these analog signals in the plural drivers and sequentially applies theses analog signals to corresponding data electrodes in the liquid crystal panel 21.

The scanning electrode driving circuit $\mathbf{24}_1$ and the scanning electrode driving circuit $\mathbf{24}_2$ shown in FIG. 1 are provided with a same configuration and a function. As shown in FIG. 4, each of the scanning electrode driving circuit $\mathbf{24}_1$ and the scanning electrode driving circuit $\mathbf{24}_2$ is mainly provided with the shift register 51, NOR gate $\mathbf{52}_1$ to NOR gate $\mathbf{52}_n$ and driver $\mathbf{53}_1$ to driver $\mathbf{53}_n$.

The shift register 51 is a serial-in parallel-out shift register including n-pieces of DFFs, executes a shift operation for shifting the start pulse $SP_2$ synchronously with the shift clock $CK_2$ based on the power supply voltage $V_{CC}$, supplies each bit of data of n-bits of parallel data to each second input terminal of the NOR gate $\mathbf{52}_1$ to the NOR gate $\mathbf{52}_n$. Each NOR gate $\mathbf{52}_1$ to NOR gate $\mathbf{52}_n$ inverts each bit of n-bits parallel data supplied from the shift register 51 and supplies each inverted bit to a corresponding driver among driver $\mathbf{53}_1$ to driver $\mathbf{53}_n$ when the enable signal EN supplied to each first input terminal from the controller 22 is an "L" level (active state). Each driver $\mathbf{53}_1$ to driver $\mathbf{53}_n$ applies amplification and buffer to each bit of n-bits of parallel data inverted and supplied from a corresponding gate $\mathbf{52}_1$ to NOR gate $\mathbf{52}_n$ and sequentially applies the parallel data to a corresponding scanning electrode among the scanning electrode $\mathbf{2}_1$ through the scanning electrode $\mathbf{2}_n$ in the liquid crystal panel 21 as n-pieces of scanning signals.

There are following reasons of the configuration in which two of the scanning electrode driving circuit $\mathbf{24}_1$ and the scanning electrode driving circuit $\mathbf{24}_2$ having same configuration and same function are provided at the left side and at the right side of the liquid crystal panel 21 and a same scanning signal is applied to a same scanning electrode at a same time.

When the liquid crystal panel 21 is a large screen, a length of a scanning electrode making up the liquid crystal panel 21 becomes longer in response to a size of the liquid crystal panel 21. Therefore, when a scanning signal is supplied from only the scanning electrode driving circuit $\mathbf{24}_1$ at the left side of the liquid crystal panel 21 as same as the conventional display driving circuit, a delay in scanning signal transmission occurs. In spite of plural TETs of which gates are connected to a same scanning electrode, the TFTs arranged near a right side of the screen can not be turned ON during the horizontal synchronous period, therefore, there is a case in that an image to be displayed during the horizontal period is not displayed.

So, two of the scanning electrode driving circuit $\mathbf{24}_1$ and the scanning electrode driving circuit $\mathbf{24}_2$ having the same configuration and the same function are provided at the right side and the left side of the liquid crystal display 21 and the same scanning signal is applied to the same electrode at the same time, and thereby all TFTs of which gates are connected to the same scanning electrode are turned ON approximately at a same time.

Next, explanations will be given of a part of an operation of the display driving circuit of the embodiment with reference to a timing chart shown in FIG. 5.

First, the power supply is turned ON, the power supply voltage $V_{cc}$ is applied to the shift register 51 in the scanning electrode driving circuit $\mathbf{24}_1$ and the scanning electrode driving circuit $\mathbf{24}_2$. In this case, in order to avoid latch-up in the scanning electrode driving circuit 24, and the scanning electrode driving circuit $\mathbf{24}_2$, the controller 22 applies a power-on-reset (not shown) so as to not output various control pulses until a constant time in which the power supply voltage $V_{cc}$ becomes stable after the power supply ON passes.

Then, after the constant time passes and the power-ON-reset is released, as shown in FIG. 1 and FIG. 2, in the controller 22, the start pulse generating circuit 31 and the shift clock generating circuit 32 respectively supply the start pulse $SP_1$ and the shift clock $CK_1$ to the data electrode driving circuit 23, and then the start pulse generating circuit 33 supplies the start pulse $SP_2$ of one vertical synchronous period to the scanning electrode driving circuit $\mathbf{24}_1$ and to the scanning electrode driving circuit $\mathbf{24}_2$. Further, in the controller 22, the shift clock generating circuit 34 generates the start pulse $SP_2$ of one horizontal synchronous period and the shift clock generating circuit 35 generates the shift clock $CK_{I2}$ having a period of, for example, 1 $\mu$s.

Further, in the enable signal generating circuit 36 shown in FIG. 3, the clear circuit 42, as shown in FIG. 5A, waveform-shapes the rising edge of the power supply voltage $V_{CC}$ applied through the resistor 41 and outputs it as a clear signal $S_{CL}$ of a "H" level. Accordingly, since the counter 44, the comparator 45 and the DFF 46 are cleared when the clear signal $S_{CL}$ rises, as shown in FIG. 5B, the enable signal EN which is an inverted output /Q of the DFF 46 becomes a "H" level (non-active state) and is supplied to an input terminal of the inverter 37, an input terminal of the AND gate 39, the scanning electrode driving circuit $\mathbf{24}_1$ and the scanning electrode driving circuit $\mathbf{24}_2$.

Figure 6:
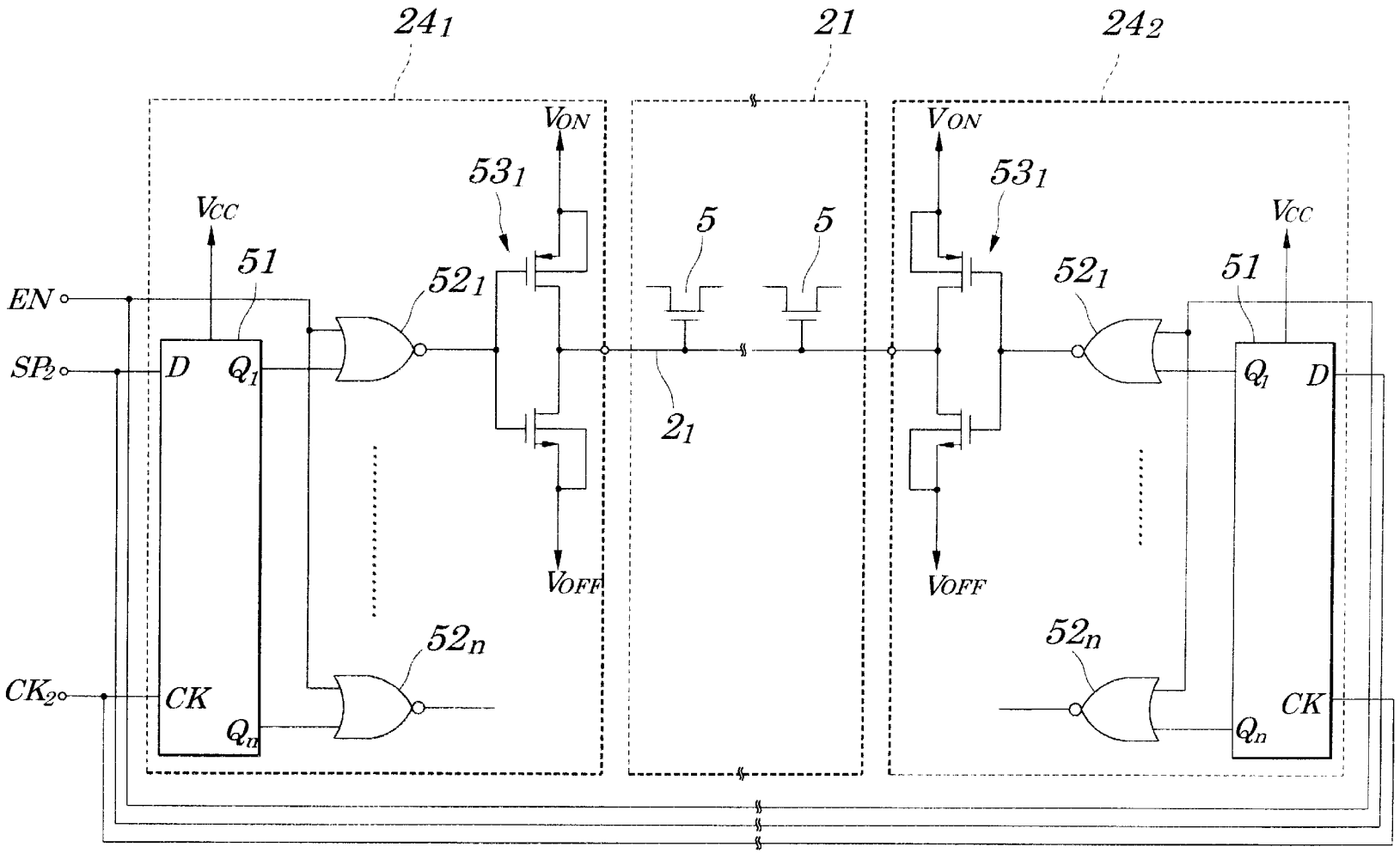
FIG. 6 is a block diagram for explaining a part of an operation of the display driving circuit according to the embodiment of the present invention.

With this operation, in the controller 22 shown in FIG. 2, since the inverter 37, the AND gate 38, the AND gate 39 and the OR gate 40 supply the shift clock $CK_{I2}$ to the scanning electrode driving circuit $\mathbf{24}_1$ and the scanning electrode driving circuit $\mathbf{24}_2$ as the shift clock $CK_2$ based on the enable signal EN of the "H" level supplied from the enable signal generating circuit 36, each shift register 51 in the scanning electrode driving circuit $\mathbf{24}_1$ and the scanning electrode driving circuit $\mathbf{24}_2$ start the shift operation for shifting the start pulse $SP_2$ at a rising of the shift clock $CK_2$. However, since the enable signal EN is the "H" level (non-active state), regardless of any state of each bit of n-bits of parallel data respectively output from each shift register 51, all output of NOR gate $\mathbf{52}_1$ to NOR gate $\mathbf{52}_n$ maintain the "L" level (output disable state). Accordingly, since all of driver $\mathbf{53}_1$ to driver $\mathbf{53}_n$ in the scanning electrode driving circuit $\mathbf{24}_1$ and the scanning electrode driving circuit $\mathbf{24}_2$ become an OFF voltage output state, there is no case in that an unstable over-current flows. For example, as shown in FIG. 6, the drivers $\mathbf{53}_1$ connected to both sides of the same scanning electrode $\mathbf{2}_1$ of the liquid crystal panel 21 are in the OFF voltage output state, therefore, a minute electric current flows even if a current flows via the scanning electrode $\mathbf{2}_1$.

However, when no NOR gate $\mathbf{52}_1$ through no NOR gate $\mathbf{52}_n$ are provided, each bit of n-bits of parallel data output from the shift register 51 is in an unstable state. Therefore, for example, as shown in FIG. 6, when the driver $\mathbf{53}_1$ at the left side in the drivers $\mathbf{53}_1$ connected to both sides of the same scanning electrode $\mathbf{2}_1$ in the liquid crystal panel 21 is in the OFF voltage output state and the driver $\mathbf{53}_1$ at the right side is in the ON voltage output state, an unstable over-current which exceeds a current supply capacity of the driver $\mathbf{53}_1$ and is several times in the normal operation flows from the driver $\mathbf{53}_1$ at the right side in the ON voltage output state to the driver $\mathbf{53}_1$ at the left side in the OFF voltage output state via the scanning electrode $\mathbf{2}_1$, a large voltage drop occurs, and then a latch-up occurs. In this case, the driver $\mathbf{53}_1$ in the ON voltage output state at the right side is destroyed and becomes impossible to operate.

Now, in the enable signal generating circuit 36, the AND gate 43 logically multiplies the clear signal $S_{CL}$ of the "H" level supplied to the first input terminal A and the enable signal EN of the "H" level supplied to the second input terminal B and supplies a logical multiplied result to the counter 44 as a counter enable signal $EN_C$ of a "H" level, therefore, the counter 44 becomes possible to operate by the counter enable signal $EN_C$ of the "H" level and counts up at a rising of each pulse of the shift clock $CK_{I2}$ having a period of 1 μs supplied from the shift clock generating circuit 35 (see FIG. 5C) and supplies count data $D_C$ to the first input terminal A of the comparator 45.

The comparator 45 always compares count data $D_C$ of twelve bits supplied to the first input terminal A with a predetermined data $D_S$ of twelve bits (such as (n−1)). Accordingly, as shown in FIG. 5C, when a (n−1)th pulse $p_{n-1}$ of the shift clock $CK_{I2}$ is supplied to the counter 44, the counter 44 supplies a value of (n−1) to the comparator 45 as count data $D_C$, therefore, the comparator 45 supplies an agreement signal $S_A$ to data input terminal D of the DFF 46. With this operation, the DFF 46 holds the agreement signal $S_A$ to be supplied to the data input terminal at a rising of a n-th pulse $p_n$ of the shift clock $CK_{I2}$ (see FIG. 5C), outputs an inverted output /Q as an enable signal EN of the "L" level (active state) (see FIG. 5B) and supplies it to the input terminal of the inverter 37, the input terminal of the AND gate 39, the scanning electrode driving circuit $\mathbf{24}_1$ and the scanning electrode driving circuit $\mathbf{24}_2$.

With this operation, in the controller 22 shown in FIG. 2, since the inverter 37, the AND gate 38, the AND gate 39 and the OR gate 40, based on the enable signal EN of the "L" level supplied from the enable signal generating circuit 36, supply the shift clock $CK_{N2}$ to the scanning electrode driving circuit $\mathbf{24}_1$ and the scanning electrode driving circuit $\mathbf{24}_2$ as the shift clock $CK_2$, each of the shift registers 51 moves to the normal shift operation in which the start pulse $SP_2$ is shifted at a rising of the shift clock $CK_2$.

On the other hand, each NOR gate $\mathbf{52}_1$ to NOR gate $\mathbf{52}_n$ in the scanning electrode driving circuit $\mathbf{24}_1$ and the scanning electrode driving circuit $\mathbf{24}_2$ receives the enable signal EN of the "L" level (active state), and thereby can invert and output each bit of n-bits of parallel data supplied from each of the shift registers 51 (output enable state).

Accordingly, when a next start pulse $SP_2$ is supplied from the controller 22, each of driver $\mathbf{53}_1$ to driver $\mathbf{53}_n$ in scanning electrode driving circuit $\mathbf{24}_1$ to scanning electrode driving circuit $\mathbf{24}_n$ applies amplification and buffer to each bit of n-bits parallel data inverted and supplied from a corresponding NOR gate $\mathbf{52}_1$ to NOR gate $\mathbf{52}_n$ and applies it to a corresponding scanning electrode $\mathbf{2}_1$ to scanning electrode $\mathbf{2}_n$ in the liquid crystal panel 21 as n-pieces of scanning signals at a same time.

As above described, with this embodiment, unstable output data from the shift register 51 immediately after releasing the power-ON-reset of the controller 22 is erased within a short time and no output data of the shift register 51 is transferred to driver $\mathbf{53}_1$ to driver $\mathbf{53}_n$ during this time, therefore, it is possible to prevent an unstable over-current in driver $\mathbf{53}_1$ to driver $\mathbf{53}_n$ from occurring and to set a current of a normal value, it is possible to completely prevent a latch-up from occurring, and it is possible to display the character, the image or the like on the liquid crystal panel 21 immediately after turning the power supply ON.

For example, in a case of a liquid crystal panel of which a resolution is 1024×768 pixels called a XGA (eXtended Graphics Array), using the conventional technique, when the shift register 51 is initialized by the shift clock $CK_{N2}$ of the one horizontal synchronous period (about 63.5 μs) used in the normal shift operation during at least one vertical synchronous period of the display area in the liquid crystal panel 1, about 16.7 ms passes. However, in this embodiment, the shift register 51 is initialized by the shift clock $CK_{I2}$ having a period of 1 μs, therefore, only 768 μs passes as a shortest time.

It is apparent that the present invention is not limited to the above embodiment but may be changed and modified without departing from the scope and spirit of the invention.

For example, in the above-mentioned embodiment, the present invention is applied to a driving circuit for driving the liquid crystal panel 21 being a large screen of eighteen or more inches and being connectable with two of the scanning electrode driving circuit $\mathbf{24}_1$ and the scanning electrode driving circuit $\mathbf{24}_2$ having the same configuration and the same function are provided at both of the right side and the left side, however, the present invention is not limited to this, the present invention may be applied to a display driving circuit for driving a liquid crystal panel 21 of eighteen or less inches connectable with a scanning electrode driving circuit only at one side.

Also, in the above-mentioned embodiment, the present invention is applied to the liquid crystal panel of the active matrix driving type using a TFT as a switch element, however, the present invention is not limited to this and may be applied any liquid crystal panel having any configuration and any function.

Also, in the above-mentioned embodiment, the present invention is applied to a driving circuit for driving the liquid crystal panel 21, however, the present invention is not limited to this and may be applied to a driving circuit for driving an EL panel.

Also, in the above-mentioned embodiment, NOR gate $\mathbf{52}_1$ to NOR gate $\mathbf{52}_n$ are provided as a gate-circuit at a rear step of the shift register 51 in a scanning electrode driving circuit, however, the present invention is not limited to this, a three-state buffer which becomes a high impedance state may be used as the gate circuit when an enable signal EN is a "H" level as a gate circuit.

Also, in the above-mentioned embodiment, setting data $D_S$ of twelve bits determining a period when an enable signal EN is an "L" level may be previously fixed before shipping from a factory or may be freely set and changed by operating an operation section, a dip switch or a like by a user.

Also, in the above-mentioned embodiment, the scanning electrode driving circuit $\mathbf{24}_1$ and the scanning electrode driving circuit $\mathbf{24}_2$ become an output enable state when an enable signal EN of an "L" level is supplied, however, the present invention is not limited to this, it is unnecessary to say that these become an output enable state when an enable signal EN of an "H" level is supplied. For example, in FIG. 3, an enable signal EN is taken from a non-inverting output Q of the DFF 46, in FIG. 2, an inverter 37 is provided at a front step of the AND gate 39 instead of a front step of the AND gate 38 and in FIG. 4, a NAND gate is provided instead of NOR gate $\mathbf{52}_1$ to NOR gate $\mathbf{52}_n$. In this case, all of driver $\mathbf{53}_1$ to driver $\mathbf{53}_n$ in the scanning electrode driving circuit $\mathbf{24}_1$ and the scanning electrode driving circuit $\mathbf{24}_2$ become the ON-output voltage state.

Furthermore, in the above-mentioned embodiment, an asynchronous counter is used as a counter to be the enable signal generating circuit 36, however, the present invention is not limited to this and a synchronous counter may be used. In this case, the DFF 46 is removed, an agreement signal $S_A$ output from the comparator 45 or a signal which an agreement signal $S_A$ through the inverter 37 is used as an enabled signal EN, the setting data $D_S$ is set to a value of n which is a number of steps (n-pieces) of the shift register 51, that is, a number of scanning electrodes forming the liquid crystal panel 21, or is set to a value n or more by two or three.

What is claimed is:

1. A display driving method for driving a display in which (n×m) pieces of pixels are arranged at intersection points of n-pieces of scanning electrodes at predetermined intervals in a row direction and m-pieces of signal electrodes at predetermined intervals in a column direction, where n of said n-pieces is a positive integer and m of said m-pieces is a positive integer, by applying each bit of n-bits of parallel data of a shift register for shifting a start pulse synchronously with a first shift clock of one horizontal synchronous period to said n-pieces of scanning electrodes and by applying m-pieces of data signals to said m-pieces of signal electrodes, said display driving method comprising:

a step of, after turning a power supply ON, supplying a second shift clock of a period shorter than said one horizontal synchronous period to said shift register for at least n-periods instead of said first shift clock, said n-periods corresponding to said n-pieces of scanning electrodes; and a step of stopping each bit of output data from said shift from transferring to n-pieces of scanning electrode drivers at least during a period corresponding to said n-periods.

2. The display driving method according to claim 1, wherein all of said n-pieces of drivers are in either an OFF voltage output state or an ON voltage output state by stopping transferring each bit of output data of said shift register to said n-pieces of drivers.

3. The display driving method according to claim 1, wherein a period of said second shift clock is 1 $\mu$s.

4. The display driving method according to claim 1, wherein said display is a liquid crystal display or an electroluminescence panel.

5. A display driving method for driving a display in which (n×m) pieces of pixels are arranged at intersection points of n-pieces of scanning electrodes at predetermined intervals in a row direction and m-pieces of signal electrodes at predetermined intervals in a column direction, where n of said n-pieces is a positive integer and m of said m-pieces is a positive integer, by applying each corresponding bit of n-bits of parallel output data of each of two shift registers for shifting a same start pulse synchronously with a first shift clock of one horizontal synchronous period to both ends of a same scanning electrode among said n-pieces of scanning electrodes and by applying m-pieces of data signals to said m-pieces of signal electrodes, said display driving method comprising:

a step of, after turning a power supply ON, supplying a second shift clock of a period shorter than said one horizontal synchronous period to said two shift registers for at least n-periods instead of said first shift clock, said n-periods corresponding to said n-pieces of scanning electrodes; and a step of stopping each bit of output data from said two shift register from transferring to each of n-pieces of scanning electrode drivers at least during a period corresponding to said n-periods.

6. The display driving method according to claim 5, wherein all of two n-pieces sets of scanning electrode drivers are in either an OFF voltage output state or an ON voltage output state by stopping transferring each bit of output data of said two shift registers to each corresponding driver among said n-pieces of scanning electrode drivers.

7. The display driving method according to claim 5, wherein a period of said second shift clock is 1 $\mu$s.

8. The display driving method according to claim 5, wherein said display is a liquid crystal display or an electroluminescence panel.

9. A display driving circuit for driving a display in which (n×m) pieces of pixels are arranged at intersection points of n-pieces of scanning electrodes at predetermined intervals in a row direction and m-pieces of signal electrodes at predetermined intervals in a column direction, where n of said n-pieces is a positive integer and m of said m-pieces is a positive integer, by applying each bit of n-bits of parallel data of a shift register for shifting a start pulse synchronously with a first shift clock of one horizontal synchronous period to said n-pieces of scanning electrodes and by applying m-pieces of data signals to said m-pieces of signal electrodes, said display driving circuit comprising:

a first shift clock generating circuit for generating a first shift clock of one horizontal synchronous period;

a second shift clock generating circuit for generating a second shift clock of a period shorter than said one horizontal synchronous period;

a shift register for shifting a start pulse synchronously with either said first shift clock or said second shift clock and outputting n-bits of parallel output data;

an enable signal generating circuit for generating an enable signal in a non-active state during a predetermined period equal to n-periods of said second shift clock at least after turning a power supply ON, said n-periods corresponding to said n-pieces of scanning electrodes;

n-pieces of gate circuits for receiving n-bits of output data of said shift register, for outputting said n-bits of output data of said shift register when said enable signal is in said active state and for not outputting n-bits of output data of said shift register when said enable signal is in said non-active state;

n-pieces of drivers for applying amplification and buffer to each bit of output data of said shift register supplied through said n-pieces of gate circuits and for outputting said output data as said n-pieces of scanning signals; and a shift clock switching circuit for supplying said second shift clock to said shift register when said enable signal is in said non-active state and for supplying said first shift clock to said shift register after said predetermined period passes.

10. The display driving circuit according to claim 9, wherein all of said n-pieces of drivers become either an OFF voltage output state or an ON voltage output state when said n-pieces of gate circuits do not output n-bits of output data of said shift register.

11. The display driving circuit according to claim 9, said enable signal generating circuit comprising:

a clear circuit for waveform shaping a rising edge of a power supply voltage when said power supply is turned ON;

an AND gate for outputting a logic multiplication of said clear signal and said enable signal as a counter enable signal;

a counter cleared when said clear signal rises, for allowing to operate by said counter enable signal, for counting up at a rising of said second shift clock and for outputting count data; and a comparator cleared when said clear signal rises, for comparing said count data with setting data corresponding to said predetermined period which is previously set and for outputting said enable signal when said count data agrees with said setting data.

12. The display driving circuit according to claim 9, wherein said gate circuit is any one of a NOR gate, a NAND gate or a three state buffer.

13. The display driving circuit according to claim 9, wherein a period of said shift clock is 1 $\mu$s.

14. The display driving circuit according to claim 9, wherein said display is a liquid crystal display or an electroluminescence panel.

15. A display driving circuit for driving a display in which (n×m) pieces of pixels are arranged at intersection points of n-pieces of scanning electrodes at predetermined intervals in a row direction and m-pieces of signal electrodes at predetermined intervals in a column direction, where n of said n-pieces is a positive integer and m of said m-pieces is a positive integer, by applying a corresponding scanning signal among n-pieces of scanning signals to both sides of a same scanning electrode among said n-pieces of scanning electrodes and by applying m-pieces of data signals to said m-pieces of signal electrodes, said display driving circuit comprising:

a first shift clock generating circuit for generating a first shift clock of one horizontal synchronous period;

a second shift clock generating circuit for generating a second shift clock of a period shorter than said one horizontal synchronous period;

a first shift register and a second shift register for shifting a start pulse synchronously with either said first shift clock or said second shift clock and for respectively outputting n-bits of parallel output data;

an enable signal generating circuit for generating an enable signal in a non-active state during a predetermined period corresponding to n-period of said second shift clock at least after turning a power supply ON, said n-periods corresponding to said n-pieces of scanning electrodes;

two n-pieces sets of gate circuits, each of n-pieces sets of gate circuits provided for each of said first shift register and said second shift register for receiving each of n-bits of output data of a corresponding shift register in said first shift register and said second shift register, for outputting said n-bits of output data of said corresponding shift register when said enable signal is in said active state and for not outputting n-bits of output data of said corresponding shift register when said enable signal is in said non-active state;

two n-pieces sets of drivers correspondingly provided for said two n-pieces sets of gate circuits and for applying amplification and buffer to a corresponding bit of output data of said corresponding shift register supplied through a corresponding gate circuit among said two n-pieces sets of gate circuits and for outputting said corresponding bit as a corresponding scanning signal; and a shift clock switching circuit for supplying said second shift clock to said first shift register and said second shift register at a same time when said enable signal is in said non-active state and for supplying said first shift clock to said first shift register and said second shift register after said predetermined period passes.

16. The display driving circuit according to claim 15, wherein all of said two n-pieces sets of drivers become either an OFF voltage output state or an ON voltage output state when said corresponding gate circuit does not output a corresponding bit of output data of said corresponding shift register.

17. The display driving circuit according to claim 15, said enable signal generating circuit comprising:

a clear circuit for waveform shaping a rising edge of a power supply voltage when said power supply is turned ON;

an AND gate for outputting a logic multiplication of said clear signal and said enable signal as a counter enable signal;

a counter cleared when said clear signal rises, for allowing to operate by said counter enable signal, for counting up at a rising of said second shift clock and for outputting count data; and a comparator cleared when said clear signal rises, for comparing said count data with setting data corresponding to said predetermined period which is previously set and for outputting said enable signal when said count data agrees with said setting data.

18. The display driving circuit according to claim 15, wherein said gate circuit is any one of a NOR gate, a NAND gate or a three state buffer.

19. The display driving circuit according to claim 15, wherein a period of said shift clock is 1 $\mu$s.

20. The display driving circuit according to claim 15, wherein said display is a liquid crystal display or an electroluminescence panel.

* * * * *